US009869181B2

(12) United States Patent
Fujioka et al.

(10) Patent No.: US 9,869,181 B2
(45) Date of Patent: Jan. 16, 2018

(54) SCROLL EXPANDER

(71) Applicant: ANEST IWATA Corporation, Yokohama-shi, Kanagawa (JP)

(72) Inventors: Tamotsu Fujioka, Yokohama (JP); Atsushi Unami, Yokohama (JP); Hiroshi Ito, Yokohama (JP); Takaaki Izumi, Yokohama (JP)

(73) Assignee: ANEST IWATA CORPORATION, Yokohama-shi, Kanagawa (JP)

( * ) Notice: Subject to any disclaimer, the term of this patent is extended or adjusted under 35 U.S.C. 154(b) by 255 days.

(21) Appl. No.: 14/927,589

(22) Filed: Oct. 30, 2015

(65) Prior Publication Data

US 2016/0123147 A1 May 5, 2016

(30) Foreign Application Priority Data

Oct. 31, 2014 (JP) ..... 2014-223177

(51) Int. Cl.
*F01C 1/02* (2006.01)
*F03C 2/02* (2006.01)
*F01C 17/06* (2006.01)

(52) U.S. Cl.
CPC ..... *F01C 1/0238* (2013.01); *F01C 17/06* (2013.01); *F03C 2/02* (2013.01); *F04C 2210/227* (2013.01); *F04C 2230/91* (2013.01)

(58) Field of Classification Search
CPC .. F01C 17/06; F01C 1/0238; F04C 2210/227; F04C 2230/91; F03C 2/02
See application file for complete search history.

(56) References Cited

U.S. PATENT DOCUMENTS 5,024,589 A * 6/1991 Jetzer ..... F01C 17/06 418/55.3
8,672,646 B2 * 3/2014 Ishizono ..... F04C 18/0207 417/410.5
9,719,510 B2 * 8/2017 Fujioka ..... F01C 1/0253
2003/0017071 A1 1/2003 Suss
2013/0309116 A1 11/2013 Unami et al.
2013/0315767 A1 11/2013 Unami et al.

FOREIGN PATENT DOCUMENTS

JP 2011-252434 A 12/2011

* cited by examiner

*Primary Examiner* — Mary A Davis
(74) *Attorney, Agent, or Firm* — Drinker Biddle & Reath LLP

(57) ABSTRACT

A scroll expander includes a driving scroll body having a first axis line a driven scroll body having a second axis line shifted with respect to the first axis line, a bearing plate including two plates coupled to the driven scroll body and having the second axis line a cylindrical driving pin attached to the driving scroll body, and a cylindrical guide ring attached to the bearing plate and having an inner diameter larger than an outer diameter of the driving pin. The driving pin includes an outer circumferential surface in contact with an inner circumferential surface of the guide ring. A hard film including diamond-like carbon is formed on the outer circumferential surface of the driving pin. The inner circumferential surface of the guide ring includes a polymer resin material with self-lubricity.

4 Claims, 4 Drawing Sheets

SCROLL EXPANDER

TECHNICAL FIELD

The present invention relates to a scroll expander to which steam is supplied as a working medium.

BACKGROUND

Scroll fluid machine compresses or expands a working medium by relative movement between scroll bodies including helical wraps. A scroll expander is a type of the scroll fluid machine. The scroll expander includes an expansion chamber formed of a pair of scroll bodies. The scroll expander converts energy upon expansion of a high-pressure working medium in the expansion chamber into rotational energy. As technology in such a field, a scroll expander described in JP 2011-252434 A has been known.

The scroll expander described in JP 2011-252434 A includes a fixed scroll and an orbiting scroll. Since rotation movement of this orbiting scroll is regulated by a rotation regulating mechanism, only revolution movement can be performed.

SUMMARY

Now then, recently, small power generation facilities have been considered. Since a scroll expander has less torque variation and has a comparatively simple apparatus configuration, the scroll expander is expected as an apparatus suitably applicable to the small power generation facilities. An example of an energy source to be input into the small power generation facilities includes steam that is discharged from a plant or the like. In an expanding process, the steam partially condenses. Condensate tends to prevent a favorable rotating state between rotary components using lubricating oil. Moreover, a bearing is sometimes used for supporting the rotary components. Here, when the number of bearings increases, mechanical energy loss tends to increase. Thus, a rotary machine such as the scroll expander requires reduction of the number of the bearings each having a rolling element and maintenance of a favorable rotating state between the rotary components in terms of reduction in energy loss.

The present invention has been made in consideration of the above-described problem. An object of the present invention is to provide a scroll expander that can maintain a favorable rotating state.

One embodiment of the present invention includes a scroll expander to which steam is supplied as a working medium. The scroll expander includes a driving scroll body that includes a pair of driving end plates and a driving wrap formed on each of the pair of driving end plates, and has a first axis line as a rotary shaft line, a driven scroll body that includes a driven end plate and a driven wrap formed on each of both surfaces of the driven end plate, is disposed between the pair of driving end plates, and has, as a rotary shaft line, a second axis line shifted with respect to the first axis line, a bearing plate disposed so as to interpose the driven scroll body, includes a pair of plates coupled to the driven scroll body, and has the second axis line as a rotary shaft line, a cylindrical driving pin that is attached to the driving scroll body, and protrudes from the driving end plate to the bearing plate, and a cylindrical guide ring that is attached to the bearing plate, and includes an inner diameter larger than an outer diameter of the driving pin. A film including diamond-like carbon is formed on an outer circumferential surface of the driving pin in contact with an inner circumferential surface of the guide ring. The inner circumferential surface of the guide ring includes a polymer resin material with self-lubricity.

The scroll expander according to the one embodiment of the present invention includes the driving pin and the guide ring. The driving pin and the guide ring regulate relative rotation movement of the driven scroll body with respect to the driving scroll body. Then, in a state where the outer circumferential surface of the driving pin is in close contact with the inner circumferential surface of the guide ring, a slide in a tangent direction of the inner circumferential surface or the outer circumferential surface occurs between the outer circumferential surface of the driving pin and the inner circumferential surface of the guide ring. This slide tolerates relative revolution movement of the driven scroll body with respect to the driving scroll body. According to this configuration, the scroll expander needs no bearing including a rolling element in order to define relative movement between the driving scroll body and the driven scroll body. Therefore, the scroll expander can suppress an increase in mechanical energy loss. Moreover, the film including diamond-like carbon is formed on the outer circumferential surface of the driving pin. The inner circumferential surface of the guide ring includes the polymer resin material with self-lubricity. A favorable sliding state is obtained due to contact between the film including diamond-like carbon and the polymer resin material with self-lubricity. Further, when condensate is present in a gap between the driving pin and the guide ring, a coefficient of friction between the driving pin and the guide ring reduces. As a result, the increase in the mechanical energy loss is further suppressed. Therefore, the scroll expander according to the one embodiment of the present invention can maintain a favorable rotating state.

In one embodiment, the driving pin may include a condensate supplying portion. The condensate supplying portion may supply condensate formed by condensation of steam to the gap between the driving pin and the guide ring. Since this condensate supplying portion supplies the condensate to the gap between the driving pin and the guide ring, a lubricating state between the driving pin and the guide ring becomes favorable. Therefore, the condensate supplying portion can suitably suppress the increase in the mechanical energy loss associated with relative rotary movement between the driving scroll body and the driven scroll body.

In one embodiment, at least one of the driving pin and the guide ring may include a condensate holding portion. The condensate holding portion may hold the condensate formed by the condensation of the steam in the gap between the driving pin and guide ring. This condensate holding portion holds the condensate in the gap between the driving pin and the guide ring. The condensate can contribute to a favorable lubricating state between the driving pin and the guide ring. Therefore, the condensate holding portion can suitably suppress the increase in the mechanical energy loss associated with the relative rotary movement between the driving scroll body and the driven scroll body.

A scroll expander according to one embodiment of the present invention can maintain a favorable rotating state.

DETAILED DESCRIPTION

An embodiment of the present invention will be described below with reference to the attached drawings. In descriptions of the drawings, substantially the same elements are denoted with the same reference signs, and redundant description thereof will be omitted.

Figure 1:
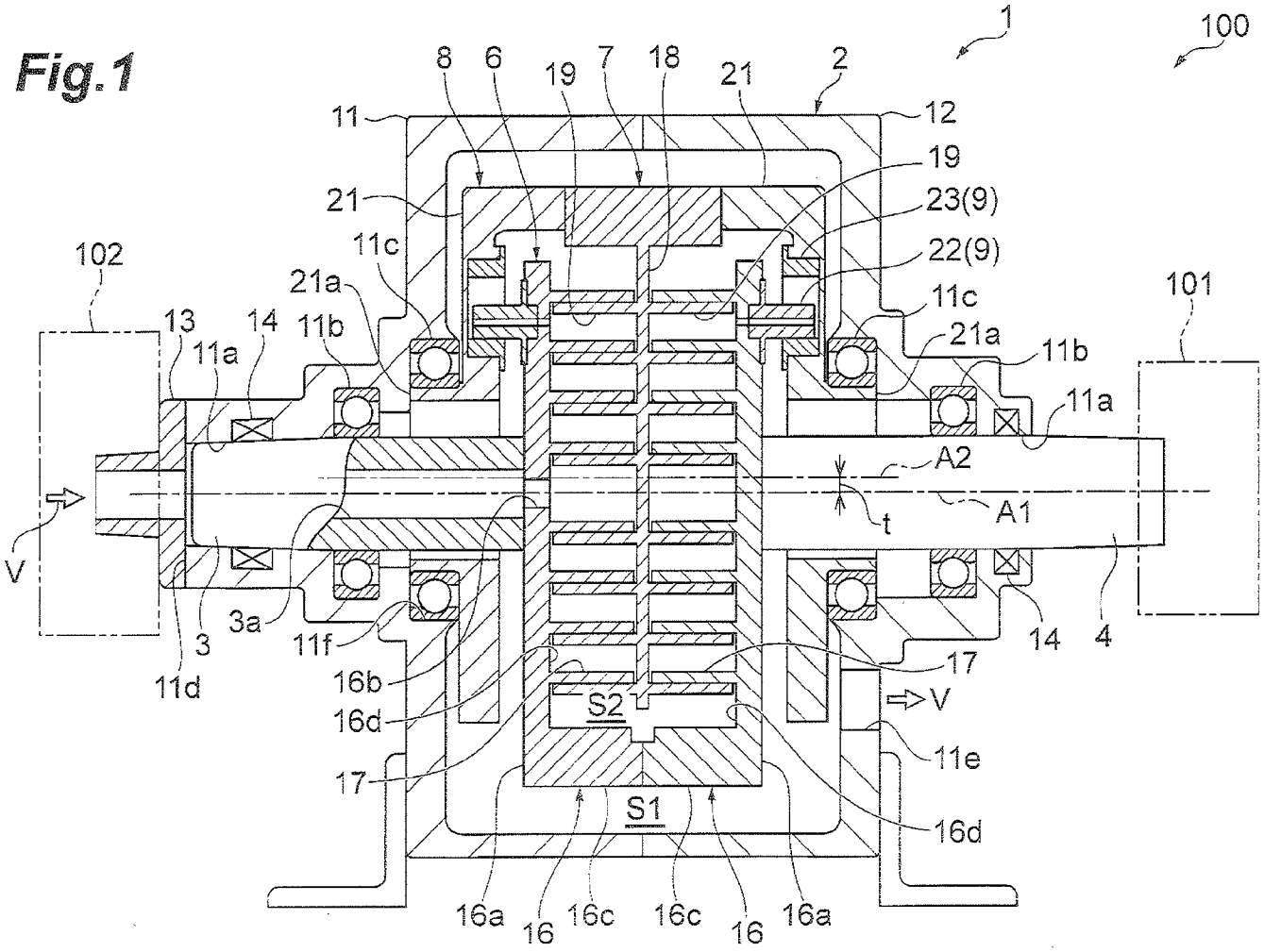
FIG. 1 is a sectional view of a scroll expander according to one embodiment of the present invention.

As illustrated in FIG. 1, a power generation system 100 including a scroll expander 1 drives a dynamo 101 by using the scroll expander 1 as a power source. A working medium supplying portion 102 supplies steam V as a working medium to the scroll expander 1. Examples of the steam V include water vapor, and a refrigerant that is used for a rankine cycle. The scroll expander 1 converts energy occurring upon expansion of the supplied steam V inside the scroll expander 1 into rotational energy. The scroll expander 1 transmits the rotational energy to the dynamo 101 through a driving shaft. The steam V after the expansion is discharged to the outside of the scroll expander 1. A temperature of the steam V to be discharged is lower than that of the steam V to be supplied. The scroll expander 1 extracts, as the rotational energy, energy corresponding to a difference between the temperature of the steam V upon the supply and the temperature of the steam V upon the discharge.

The scroll expander 1 includes, as main constituent components, a housing 2, an input driving shaft 3, an output driving shaft 4, a driving scroll body 6, a driven scroll body 7, a bearing plate 8, and an interlocking mechanism 9.

The housing 2 includes a pair of cases 11 and 12. The housing 2 forms a housing space S1. The housing space S1 houses the driving scroll body 6, the driven scroll body 7, the bearing plate 8, and the interlocking mechanism 9. The case 11 includes a shaft hole 11*a*. The input driving shaft 3 is inserted into the shaft hole 11*a*. A central axis line of the shaft hole 11*a* defines a first axis line A1. A driving bearing 11*b* and a driven bearing 11*c* are disposed in the case 11. The driving bearing 11*b* rotatably supports the input driving shaft 3. The driven bearing 11*c* rotatably supports the bearing plate 8. A central axis line of the driving bearing 11*b* corresponds to the first axis line A1. Meanwhile, a central axis line of the driven bearing 11*c* corresponds to a second axis line A2. The second axis line A2 is shifted by a distance t with respect to the first axis line A1. The second axis line A2 is defined by a central axis line of a bearing holding portion 11*f*. The driven bearing 11*c* is fitted into the bearing holding portion 11*f*. A cap 13 is attached to an opening end 11*d* of the case 11. The cap 13 serves as an interface with the working medium supplying portion 102. In a direction of the first axis line A1, an oil seal 14 is disposed between the driving bearing 11*b* and the opening end 11*d*. The case 12 includes substantially the same structure as the case 11. That is, the case 12 includes the shaft hole 11*a*. The driving bearing 11*b* and the driven bearing 11*c* are disposed in the case 12. Moreover, the case 12 includes an outlet 11*e*. The outlet 11*e* discharges the steam V after the expansion.

The input driving shaft 3 is inserted into the shaft hole 11*a* of the case 11. Therefore, a rotary shaft line of the input driving shaft 3 corresponds to the first axis line A1. One end of the input driving shaft 3 is attached to the driving scroll body 6. The input driving shaft 3 includes a working medium introducing hole 3*a*. The steam V is introduced through the working medium introducing hole 3*a*. The working medium introducing hole 3*a* penetrates from the one end to the other end of the input driving shaft 3. The output driving shaft 4 is inserted into the shaft hole 11*a* of the case 12. Therefore, a rotary shaft line of the output driving shaft 4 corresponds to the first axis line A1. One end of the output driving shaft 4 is attached to the driving scroll body 6. Moreover, the other end of the output driving shaft 4 is coupled to the dynamo 101.

The housing space S1 houses the driving scroll body 6. The driving scroll body 6 is rotatable around the first axis line A1. The driving scroll body 6 includes a pair of driving end plates 16 and a pair of driving wraps 17. Each of the pair of driving end plates 16 includes a disk-like shape. An outer circumferential edge portion 16*c* of one of the driving end plates 16 is coupled to the outer circumferential edge portion 16*c* of the other driving end plate 16. The input driving shaft 3 is attached to an outer surface 16*a* of the one driving end plate 16. Moreover, the one driving end plate 16 includes a working medium introducing hole 16*b*. The steam V is introduced through the working medium introducing hole 16*b*. The working medium introducing hole 16*b* communicates with the working medium introducing hole 3*a* of the input driving shaft 3. The output driving shaft 4 is attached to the outer surface 16*a* of the other driving end plate 16. The driving wrap 17 is formed on an inner surface 16*d* of the driving end plate 16. The driving wrap 17 includes a helical shape or a spiral shape. That is, the driving wraps 17 are disposed between the pair of driving end plates 16. The above-described input driving shaft 3 and the above-described output driving shaft 4 are integrally formed through the driving scroll body 6. The input driving shaft 3, the output driving shaft 4, and the driving scroll body 6 integrally rotate around the first axis line A1.

The housing space S1 houses the driven scroll body 7. The driven scroll body 7 is rotatable around the second axis line A2. The driven scroll body 7 includes a driven end plate 18 and a driven wrap 19. The driven end plate 18 includes a disk-like shape. The driven end plate 18 is disposed between the driving end plates 16 of the driving scroll body 6. The driven end plate 18 is coupled to the bearing plate 8. The driven wrap 19 is formed on each surface of the driven end plate 18 in a direction toward the driving end plates 16. The driven wrap 19 includes a helical shape or a spiral shape. The driving end plates 16, the driven end plate 18, the driving wraps 17, and the driven wraps 19 form an expansion chamber S2. The expansion chamber S2 for expanding the steam V includes a helical shape or a spiral shape.

The bearing plate 8 rotatably supports the driven scroll body 7 around the second axis line A2. The bearing plate 8 includes a pair of plates 21. The plates 21 each include substantially a disk-like shape. In a direction of the first axis line A1 (or the second axis line A2), one of the pair of plates 21 is disposed between the one driving end plate 16 and the case 11. The other plate 21 is disposed between the other driving end plate 16 and the case 12. That is, the bearing plate 8 is disposed so as to interpose the driving scroll body 6 and the driven scroll body 7. An outer circumferential edge portion of the plate 21 is coupled to an outer circumferential edge portion of the driven end plate 18. The plate 21 includes a rotary shaft portion 21*a*. A rotary central shaft of the rotary shaft portion 21*a* is the second axis line A2. The rotary shaft portion 21*a* is formed on the side of a surface of the plate 21, the surface facing the case 11. The rotary shaft portion 21*a* fits into the driven bearing 11*c*. Therefore, the bearing plate 8 and the driven scroll body 7 rotate around the second axis line A2. This driven scroll body 7 is coupled to the bearing plate 8.

Figure 2:
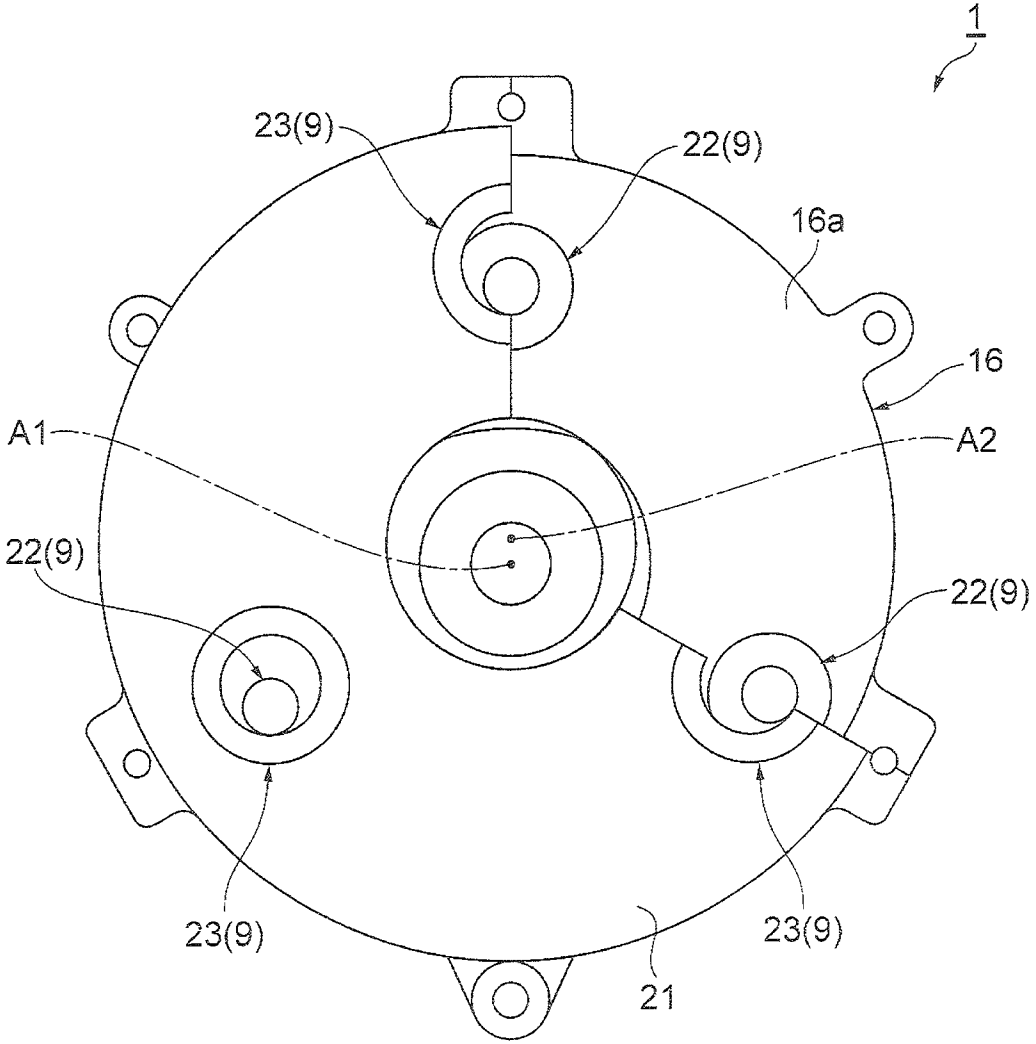
FIG. 2 is a front view of disposition of a driving pin and a guide ring.

The interlocking mechanism 9 interlocks the driving scroll body 6 and the driven scroll body 7. Specifically, the interlocking mechanism 9 mutually synchronously rotates the driving scroll body 6 and the driven scroll body 7. The interlocking mechanism 9 includes a driving pin 22 and a guide ring 23. The driving pin 22 is attached to the driving scroll body 6. The guide ring 23 is attached to the bearing plate 8. As illustrated in FIG. 2, the scroll expander 1 includes three pairs of interlocking mechanisms 9. The three pairs of interlocking mechanisms 9 are disposed at substantially equal intervals along a direction of the circumference of a circle around the first axis line A1. Each of the three pairs of interlocking mechanisms 9 is disposed on a virtual axis line parallel to the first axis line A1. One of the pair of interlocking mechanisms 9 is disposed on the side of the input driving shaft 3. The other of the pair of interlocking mechanisms 9 is disposed on the side of the output driving shaft 4.

Figure 3:
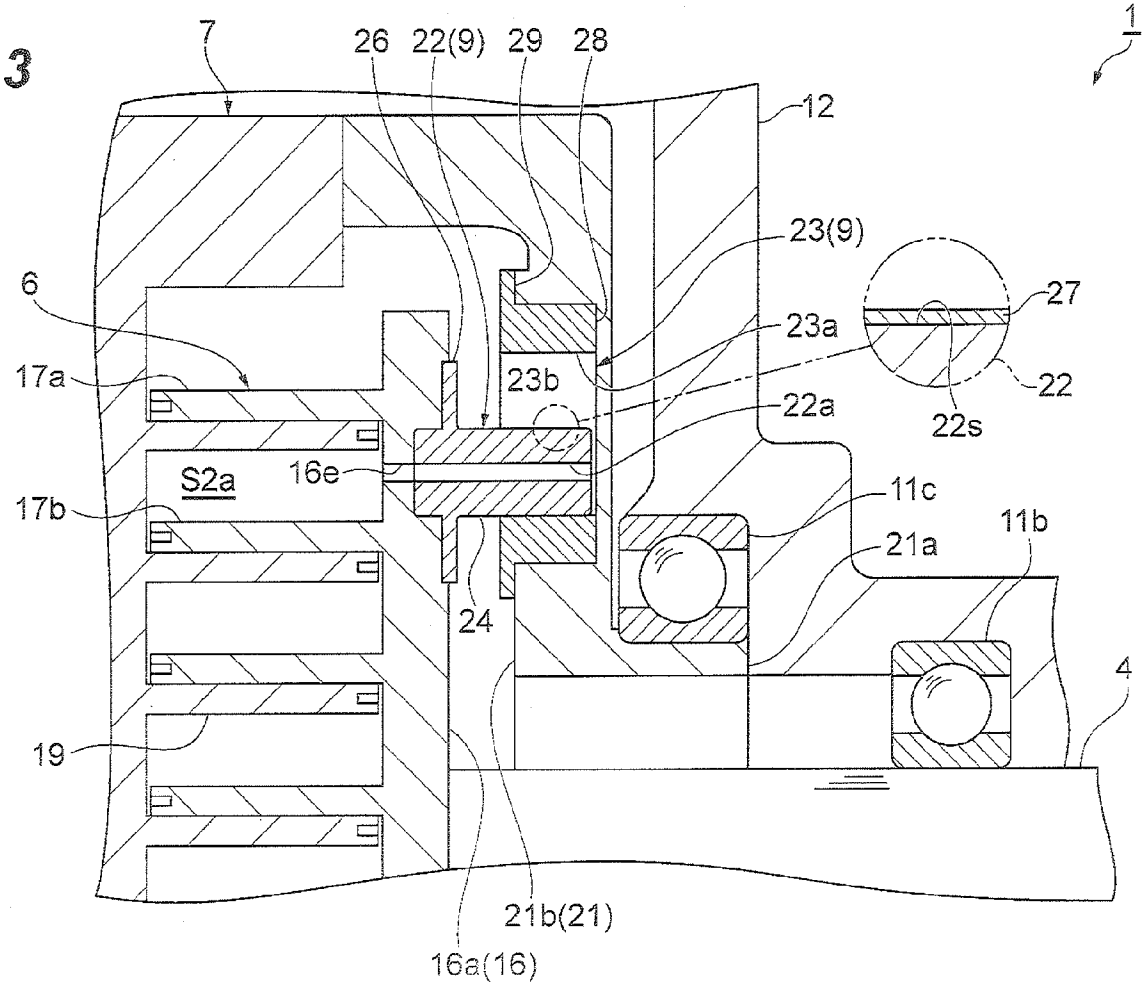
FIG. 3 is an enlarged sectional view illustrating the driving pin and the guide ring.

As illustrated in FIG. 3, one end side of the driving pin 22 is attached to the driving end plate 16 of the driving scroll body 6. The other end side of the driving pin 22 is disposed inside the guide ring 23. The driving pin 22 includes a pin portion 24 and a flange portion 26. The pin portion 24 includes a columnar shape that extends along the direction of the first axis line A1. The flange portion 26 is formed on the one end side of the driving pin 22. The pin portion 24 and the flange portion 26 are integrally formed. The driving pin 22 includes a metallic material (for example, SUS303 material). One end of the pin portion 24 is fitted into a recess portion of the driving end plate 16. The flange portion 26 is fixed to the outer surface 16*a* of the driving end plate 16 by, for example, a bolt. The other end side of the pin portion 24 is disposed inside the guide ring 23.

An outer circumferential surface 22*s* on the other end side of the pin portion 24 comes in contact with an inner circumferential surface 23*a* of the guide ring 23. The outer circumferential surface 22*s* includes a hard film 27. The hard film 27 is formed of an amorphous material that mainly includes a hydrocarbon or an isotope of carbon. Specifically, the hard film 27 is formed of diamond-like carbon (DLC). The hard film 27 has a thickness of 1 μm or more and 5 μm or less, for example. The hard film 27 including diamond-like carbon imparts lubricity and wear resistance to a contact portion of the driving pin 22 with the guide ring 23. The hard film 27 may include other components as an add-in material other than the hydrocarbon or the isotope of carbon as the main component. For example, a plasma CVD method or a PVD method is used for forming the hard film 27.

The driving pin 22 includes a condensate supplying hole 22*a* as a condensate supplying portion. The condensate supplying hole 22*a* leads the steam V or condensate to the inside of the guide ring 23. The condensate supplying hole 22*a* supplies the condensate to a gap between the guide ring 23 and the driving pin 22. When the steam V is water vapor, the condensate is water. The condensate supplying hole 22*a* is a through-hole that passes from one end surface to the other end surface of the pin portion 24. The one end side of the pin portion 24 is fitted into the driving end plate 16. The condensate supplying hole 22*a* communicates with a condensate supplying hole 16*e* of the driving end plate 16 on the one end side of the pin portion 24. The expansion chamber S2 is connected to the inside of the guide ring 23 through the condensate supplying hole 16*e* and the condensate supplying hole 22*a*. Therefore, the steam V or the condensate in the expansion chamber S2 is introduced into the inside of the guide ring 23. Note that the steam V after the expansion is preferably introduced into the guide ring 23. Therefore, the condensate supplying hole 16*e* of the driving end plate 16 may be provided at a position that communicates with a space S2*a* formed of the driving wrap 17. The space S2*a* is a space between an outermost circumferential driving wrap portion 17*a* of the driving scroll body 6 and a driving wrap portion 17*b* adjacent to the driving wrap portion 17*a*. Moreover, the driving pin 22 including the condensate supplying hole 22*a* that communicates with the condensate supplying hole 16*e* may be attached to the same position as the condensate supplying hole 16*e* on the driving end plate 16. Specifically, the driving pin 22 is attached to the driving end plate 16 such that an axis line of the condensate supplying hole 16*e* is disposed between the driving wrap portions 17*a* and 17*b*.

The guide ring 23 is attached to an inner surface 21*b* of the plate 21. The inner surface 21*b* of the plate 21 faces the outer surface 16*a* of the driving scroll body 6. The guide ring 23 includes a polymer resin material with self-lubricity. An example of the polymer resin material includes a polyether ether ketone (PEEK) resin. Note that the guide ring 23 may include a polyphenylene sulfide (PPS) resin. The guide ring 23 includes a cylindrical shape. The guide ring 23 includes a ring portion 28 and a flange portion 29. The flange portion 29 is formed on one end side of the ring portion 28. The ring portion 28 is fitted into a recess portion of the plate 21. The flange portion 29 is fixed to the plate 21 by a bolt. The ring portion 28 includes a guide hole 23*b*. The driving pin 22 is disposed in the guide hole 23*b*. The guide hole 23*b* is defined by the inner circumferential surface 23*a* of the guide ring 23. An inner diameter of the guide hole 23*b* is larger than an outer diameter of the pin portion 24 of the driving pin 22. A central axis line of the driving pin 22 is shifted with respect to a central axis line of the guide ring 23. An amount of this shift is substantially the same as that of the second axis line A2 with respect to the first axis line A1 (distance t, refer to FIG. 1). Therefore, the hard film 27 of the driving pin 22 comes in contact with the inner circumferential surface 23*a* of the ring portion 28.

As illustrated in FIG. 1, the working medium supplying portion 102 supplies the steam V to the scroll expander 1 including the above-described configuration through the cap 13. The steam V is introduced into the expansion chamber 82 through a through-hole of the cap 13 and the working medium introducing hole 3*a* of the input driving shaft 3. The steam V introduced into the expansion chamber S2 expands in a space formed of the driving wrap 17 and driven wrap 19. Then, the steam V moves from the center of the expansion chamber S2 to an outer circumference of the expansion chamber S2. The steam V discharged from the expansion chamber S2 to the inside of the housing 2 is discharged from the outlet 11*e*. Relative revolution movement of the driven scroll body 7 with respect to the driving scroll body 6 (orbiting movement) occurs due to this expansion. When viewed from the housing 2, this revolution movement is observed as rotary movement of the driving scroll body 6 around the first axis line A1 and rotary movement of the driven scroll body 7 around the second axis line A2. Therefore, the output driving shaft 4 attached to the driving scroll body 6 rotates around the first axis line A1. This rotary movement of the output driving shaft 4 is transmitted to the dynamo 101.

This scroll expander 1 regulates relative rotation movement of the driven scroll body 7 with respect to the driving scroll body 6 by the driving pin 22 and the guide ring 23, and tolerates the relative revolution movement. The scroll expander 1 based on this principle is simple and have few constituent elements. Therefore, reduction in a manufacturing cost is achieved. Then, the driving pin 22 and the guide ring 23 regulate the relative rotation movement of the driven scroll body 7 with respect to the driving scroll body 6. Then, in a state where the outer circumferential surface 22*s* of the driving pin 22 is in close contact with the inner circumferential surface 23*a* of the guide ring 23, a slide in a tangent direction of the inner circumferential surface 23*a* or the outer circumferential surface 22*s* occurs between the outer circumferential surface 22*s* of the driving pin 22 and the inner circumferential surface 23*a* of the guide ring 23. This slide tolerates the revolution movement of the driven scroll body 7 with respect to the driving scroll body 6. Therefore, the scroll expander 1 needs no bearing including a rolling element in order to define the relative movement between the driving scroll body 6 and the driven scroll body 7. Therefore, the scroll expander 1 can suppress an increase in the mechanical energy loss. Further, the hard film 27 including diamond-like carbon is formed on the outer circumferential surface 22*s* of the driving pin 22. The guide ring 23 includes the polyether ether ketone resin. A favorable sliding state is obtained due to contact between the hard film 27 and the polyether ether ketone resin. Therefore, the stable orbiting movement can be realized with low abrasion over a long period. Further, when the condensate is present in the gap between the driving pin 22 and the guide ring 23, since a coefficient of friction between the driving pin 22 and the guide ring 23 reduces, further reduction in the mechanical energy loss can be achieved. Therefore, the scroll expander 1 can maintain a favorable rotating state.

The driving pin 22 includes the condensate supplying hole 22*a*. The condensate formed by condensation of the steam V is supplied to the gap between the driving pin 22 and the guide ring 23 through the condensate supplying hole 22*a*. The steam V or the condensate is forcibly supplied by expansion pressure of the steam V in the expansion chamber S2 toward an opening on the side of a top of the driving pin 22 through the condensate supplying hole 22*a*. Therefore, the condensate is forcibly supplied to the gap between the driving pin 22 and the guide ring 23. Since a lubricating state between the driving pin 22 and the guide ring 23 becomes favorable due to this condensate, reduction in the mechanical energy loss associated with relative rotary movement of the driven scroll body 7 with respect to the driving scroll body 6 can be achieved. Then, stable supply of the condensate can reduce required power and operation noise. In short, the scroll expander 1 uses, as a lubricant, the condensate formed by the condensation of evaporated gas due to the expansion.

The embodiment of the present invention has been described above. However, the present invention is not limited to the above-described embodiment. The present invention may include a modification without changing the spirit described in the claims.

Figure 4A:
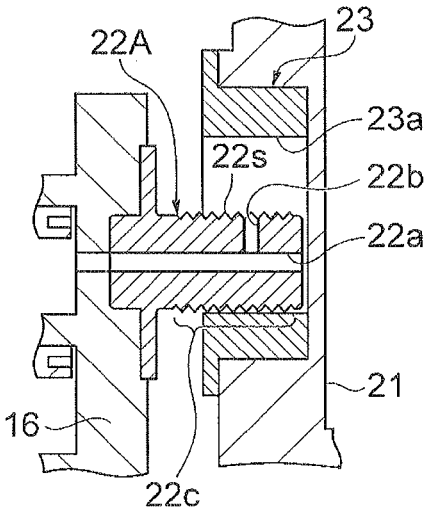
FIGS. 4A to 4C are enlarged sectional views illustrating a driving pin and a guide ring of a scroll expander according to a modification.

For example, as illustrated in FIG. 4A, in addition to the condensate supplying hole 22*a*, a driving pin 22A may include another condensate supplying hole 22*b* as the condensate supplying portion. The condensate supplying hole 22*b* extends from the condensate supplying hole 22*a* to an outer circumferential surface 22*s* along a diameter direction of the driving pin 22A. The steam V or the condensate can be supplied directly to the outer circumferential surface 22*s* of the driving pin 22A through the condensate supplying hole 22*b*. The driving pin 22A rotates around the first axis line A1 together with the driving scroll body 6. Therefore, the steam V or the condensate can be efficiently supplied to the outer circumferential surface 22*s* through the condensate supplying hole 22*b* by centrifugal force of the rotation. Therefore, the condensate as a lubricating liquid is stably continuously supplied to a gap between the driving pin 22A and the guide ring 23. As a result, a favorable lubricating state can be held.

Further, in addition to the condensate supplying holes 22*a* and 22*b*, the driving pin 22A may include a spiral groove 22*c* as the condensate supplying portion. The spiral groove 22*c* is formed on the outer circumferential surface 22*s* in contact with the inner circumferential surface 23*a* of the guide ring 23. According to this configuration, when the steam V after the expansion discharged from the expansion chamber S2 condenses around the driving pin 22A, the condensate can reach the entire spiral groove 22*c* by a capillary action. Therefore, the condensate as a lubricating liquid is stably continuously supplied to the gap between the driving pin 22A and the guide ring 23. As a result, a favorable lubricating state can be held.

Figure 4B:
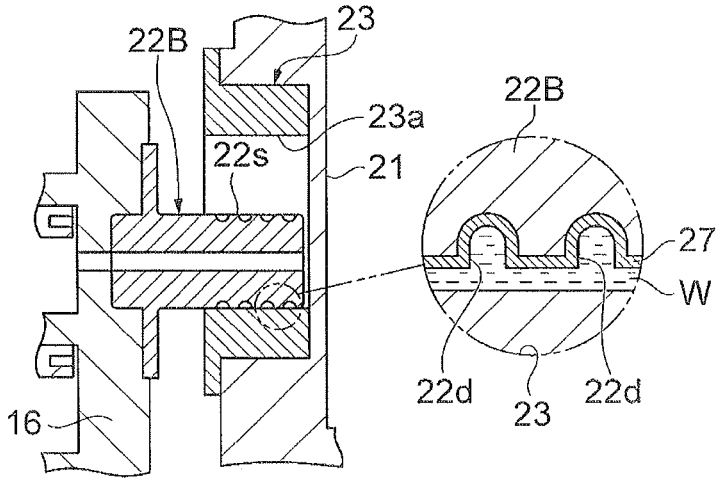
Figure 4C:
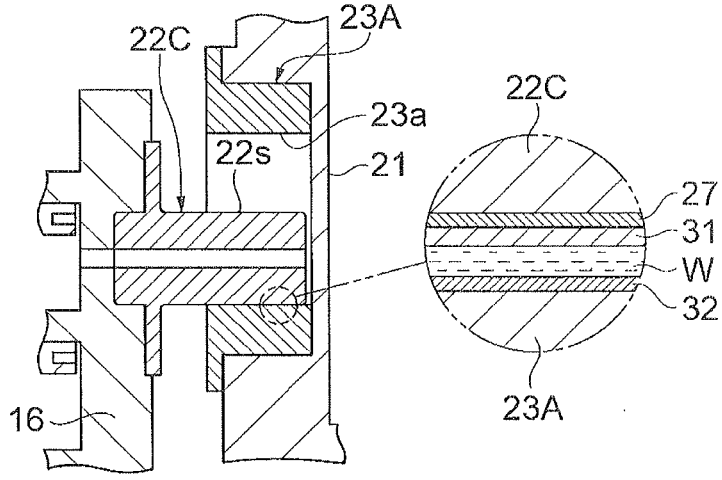

As illustrated in FIG. 4B, a driving pin 22B may include a dimple 22*d* as the condensate holding portion. The dimple 22*d* holds a condensate film W occurring on a contact interface between the driving pin 22B and the guide ring 23. As illustrated in FIG. 4C, a driving pin 22C may include a hydrophilic film 31 formed on an outer circumferential surface 22*s* of the driving pin 22C. Specifically, the hydrophilic film 31 is formed on the hard film 27. Moreover, a guide ring 23A may include a hydrophilic film 32 formed on an inner circumferential surface 23*a* of the guide ring 23A. The scroll expander 1 may include both of the hydrophilic films 31 and 32, or either the hydrophilic film 31 or 32. That is, the scroll expander 1 may include at least one of the hydrophilic films 31 and 32. The dimple 22*d* and the hydrophilic films 31 and 32 suppress scattering of the condensate film W as a lubricating liquid. As a result, a favorable lubricating state can be held.

What is claimed is:

1. A scroll expander to which steam is supplied as a working medium, comprising:

a driving scroll body that includes a pair of driving end plates and a driving wrap formed on each of the pair of driving end plates, and has a first axis line as a rotary shaft line;

a driven scroll body that includes a driven end plate and a driven wrap formed on each of both surfaces of the driven end plate, is disposed between the pair of driving end plates, and has, as a rotary shaft line, a second axis line shifted with respect to the first axis line;

a bearing plate that is disposed so as to interpose the driven scroll body, includes a pair of plates coupled to the driven scroll body, and has the second axis line as a rotary shaft line;

a cylindrical driving pin that is attached to the driving scroll body, and protrudes from the driving end plate to the bearing plate; and a cylindrical guide ring that is attached to the bearing plate, and includes an inner diameter larger than an outer diameter of the driving pin, wherein a film including diamond-like carbon is formed on an outer circumferential surface of the driving pin in contact with an inner circumferential surface of the guide ring, and the inner circumferential surface of the guide ring includes a polymer resin material with self-lubricity.

2. The scroll expander according to claim 1, wherein the driving pin includes a condensate supplying portion, and the condensate supplying portion supplies condensate formed by condensation of the steam to a gap between the driving pin and the guide ring.

3. The scroll expander according to claim 2, wherein at least one of the driving pin and the guide ring includes a condensate holding portion, and the condensate holding portion holds the condensate formed by the condensation of the steam in the gap between the driving pin and the guide ring.

4. The scroll expander according to claim 1, wherein at least one of the driving pin and the guide ring includes a condensate holding portion, and the condensate holding portion holds the condensate formed by the condensation of the steam in the gap between the driving pin and the guide ring.

* * * * *